United States Patent [19]

Bernotus et al.

[11] 3,969,918

[45] July 20, 1976

[54] METHOD AND APPARATUS FOR BLANKING COIL STOCK FOR TRANSFER PRESSES

[75] Inventors: Donald E. Bernotus, Dyer, Ind.; Leo L. Levitt, Harvey, Ill.

[73] Assignee: Verson Allsteel Press Company, Chicago, Ill.

[22] Filed: Jan. 6, 1975

[21] Appl. No.: 538,548

[52] U.S. Cl. ..... 72/337; 72/405; 72/419; 72/421; 72/427; 113/113 A; 113/113 B; 113/116 V

[51] Int. Cl.[2] ..... B21D 28/00

[58] Field of Search ..... 72/337, 336, 338, 405, 72/419, 421, 426, 427; 113/1 D, 1 F, 113 A, 113 B, 116 V, 116 Y

[56] References Cited

UNITED STATES PATENTS

| | | | |
|---|---|---|---|
| 2,305,064 | 12/1942 | Colwell et al. | 72/405 X |
| 3,432,042 | 3/1969 | Bautz et al. | 294/115 X |
| 3,641,959 | 2/1972 | Hurst | 113/121 A |
| 3,683,834 | 8/1972 | Potts et al. | 113/1 F |
| 3,768,295 | 10/1973 | Cudzik | 72/347 |

*Primary Examiner*—C.W. Lanham
*Assistant Examiner*—James R. Duzan
*Attorney, Agent, or Firm*—Wallenstein, Spangenberg, Haltis & Strampel

[57] ABSTRACT

A method and apparatus are provided for blanking from coil stock blanks to be supplied to and formed by a transfer press having a transfer feed line through the transfer press along which the blanks are fed. The coil stock is fed along a coil stock feed line which is below the transfer feed line of the transfer press over a male blanking punch. A female blanking die is lowered from above the transfer feed line of the press over the male blanking punch for blanking blanks from the coil stock. The blanks so formed are elevated from the male blanking punch to the transfer feed line of the press for transfer thereof along the transfer feed line. The scrap of the coil stock resulting from such blanking operation is discharged along the coil stock feed line below the transfer feed line of the press so as not to interfere with the transfer of the blanks along the transfer feed line of the press. Provision is made for stripping the blanks from the female blanking die and for stripping the coil stock from the male blanking punch. Preferably, the male blanking punch and the female blanking die are arranged within the transfer press and are carried, respectively, by the bolster carriage and adapter and by the slide adapter which carry the work forming die parts of the transfer press, with the transfer mechanism also being carried by the bolster carriage and adapter, to provide a removable unitary die structure for the press.

31 Claims, 10 Drawing Figures

METHOD AND APPARATUS FOR BLANKING COIL STOCK FOR TRANSFER PRESSES

This invention has to do with blanking from coil stock blanks to be supplied to and formed by transfer presses. Transfer presses usually comprise a frame, a bed, and a power driven slide, a plurality of longitudinally spaced stations including die parts associated with the bed and the slide for performing multiple operations in sequence on individual work pieces or blanks as the slide is lowered and raised, and transfer means for transferring sequentially the individual work pieces or blanks along a press transfer feed line from station to station to perform in sequence the multiple operations thereon. Such transfer presses having such transfer means may be, for example, of the type disclosed in U.S. Pat. Nos. 3,430,779, 3,432,042 and 3,512,391. Such transfer presses differ from progressive die presses wherein multiple operations are performed on the coil stock as it is fed through the press.

Transfer presses may have individual pre-blanked work pieces or blanks fed into the press along the transfer feed line by use of several different types of blank feeders. Transfer presses may also have continuous coil stock fed from a coil to the press. This invention is directed to the blanking of such continuous coil stock fed to the transfer press.

The conventional method of blanking in transfer presses from continuous coil stock is to blank downwardly through a female blanking die which may be associated with the bed of the press with a punch associated with the slide of the press. The blank falls through the female die which is made with a slot on its underside to permit pusher fingers (or shuttle mechanism) to push the blank out from under the femal die into an open area for subsequent transfer through the press by the transfer means along the transfer feed line of the press. The coil stock is fed into the blanking die along a coil stock feed line which is above the transfer feed line of the press. Depending upon the size of the blank in relation to the coil stock width there may be a continuous coil stock skeleton which must be cut into pieces for scrap disposal. In some cases the coil stock is cut through during blanking and, in either event, the scrap must be diverted by scrap chutes.

This conventional method of blanking coil stock in transfer presses has numerous disadvantages. It requires a separate shuttle mechanism or pusher fingers to remove the blank from underneath the blanking die. The blanking is done at the coil stock feed line which is above the transfer feed line of the press and it is often difficult to dispose of the scrap without entanglement with the transfer means of the press. This method normally requires that a separate blanking slide be provided outside of the press column. Placement of the blanking die within the main die space of the transfer press increases the difficulty in disposal of the scrap and very often requires two idle transfer stations for transfer feed finger clearance for the press transfer means.

The principal object of this invention is to provide an improved method and apparatus for blanking from coil stock blanks to be supplied to and formed by transfer presses, having a transfer feed line through the transfer press along which the blanks are fed, which overcome the aforementioned disadvantages prevalent in the conventional methods and apparatus of blanking coil stock in transfer presses.

Briefly, in accordance with this invention, the coil stock is fed along a coil stock feed line which is below the transfer feed line of the transfer press over a male blanking punch. A female blanking die is lowered from above the transfer feed line of the press over the male blanking punch for blanking blanks from the coil stock and raised above the transfer feed line of the press. The blanks so formed are elevated, as the female blanking die is raised, from the male blanking punch to the transfer feed line of the press for transfer thereof along the transfer feed line of the press by the press transfer means. The scrap of the coil stock resulting from such blanking operation is discharged along the coil stock feed line below the transfer feed line of the press. As a result, the scrap cannot interfere with the transfer of the blanks along the transfer feed line of the press.

The elevating means for elevating the blanks from the male blanking punch to the transfer feed line of the press preferably includes a magnetic pickup means or a vacuum pickup means for releasably engaging and lifting the blanks so that the blanks may be readily gripped and transferred along the transfer feed line of the press by the transfer means.

Stripping means are associated with the female blanking die for stripping the blanks therefrom and stripping means are associated with the male blanking punch for stripping the coil stock therefrom as the female blanking die is being raised to facilitate the blanking operation. Preferably, the stripping occurs near the beginning of the raising of the female blanking die.

Where the size of the blank in relation to the coil stock width is such as to cause a continuous coil stock skeleton following blanking, shear knives associated with the male blanking punch are provided to cut the skeleton into pieces for ready scrap disposal below the transfer feed line of the press.

The blanking apparatus of this invention may be arranged outside of the press column and operated by a separate blanking slide, or it may be arranged inside a secondary die space of the press where it would be operated by a secondary slide of the press, or it may be arranged inside the main die space of the press where it would be operated by the main slide of the press. The latter alternative is preferred since the blanking apparatus of this invention is particularly adapted for such an arrangement and considerable set up or tool changing time can be saved when converting from one blank forming operation to another to produce different parts.

In this latter respect, the transfer presses utilize a slide adapter removably clamped to the slide of the press for carrying the upper press die parts associated with the slide and a bolster carriage and adapter removably clamped to the bed of the press for carrying the lower die parts associated with the bed and also the transfer means. To remove a complete die set from the press the upper tooling is lowered onto the lower tooling and unclamped and then the bolster carriage is unclamped and it and all of the tooling are rolled laterally from the press die space and then another set of tooling carried on another moving bolster carriage is immediately moved into the press die space accomplishing complete die change very quickly. This is of great inportance since transfer presses are high production units, having a speed range which may vary from 15 SPM to 300 SPM, and have a cost which is considerably more than standard presses of equivalent size and capacity. Because of such high productive capacity and relatively high cost, users must in many instances use transfer presses to produce several different parts, with each requiring its own set of tooling.

Preferably, the male blanking punch of the blanking apparatus is carried by the bolster carriage and adapter and the female blanking die and elevating means of the blanking apparatus are carried by the slide adapter so that the blanking apparatus is made part of the die set and is moved in and out of the press die space with the other tooling and the transfer means. Therefore, no additional time is required to change the blanking apparatus or the transfer means thereof, as would be required in the other aforementioned alternative arrangements of the blanking apparatus. Since the blanking of the coil stock is done at the coil stock feed line which is below the transfer feed line of the tooling, the scrap resulting from the blanking operation will not interfere with operation of the die set and the transfer means thereof and may be readily laterally disposed of by chutes or the like.

Other objects of this invention reside in the construction of the blanking apparatus, the cooperative relationships between the component parts thereof, the cooperative relationships between the steps of the blanking method and the cooperative relationships between the blanking method and apparatus and the transfer press.

Other objects and advantages of this invention will become apparent to those skilled in the art upon reference to the accompanying specification, claims and drawings in which:

Figure 1:
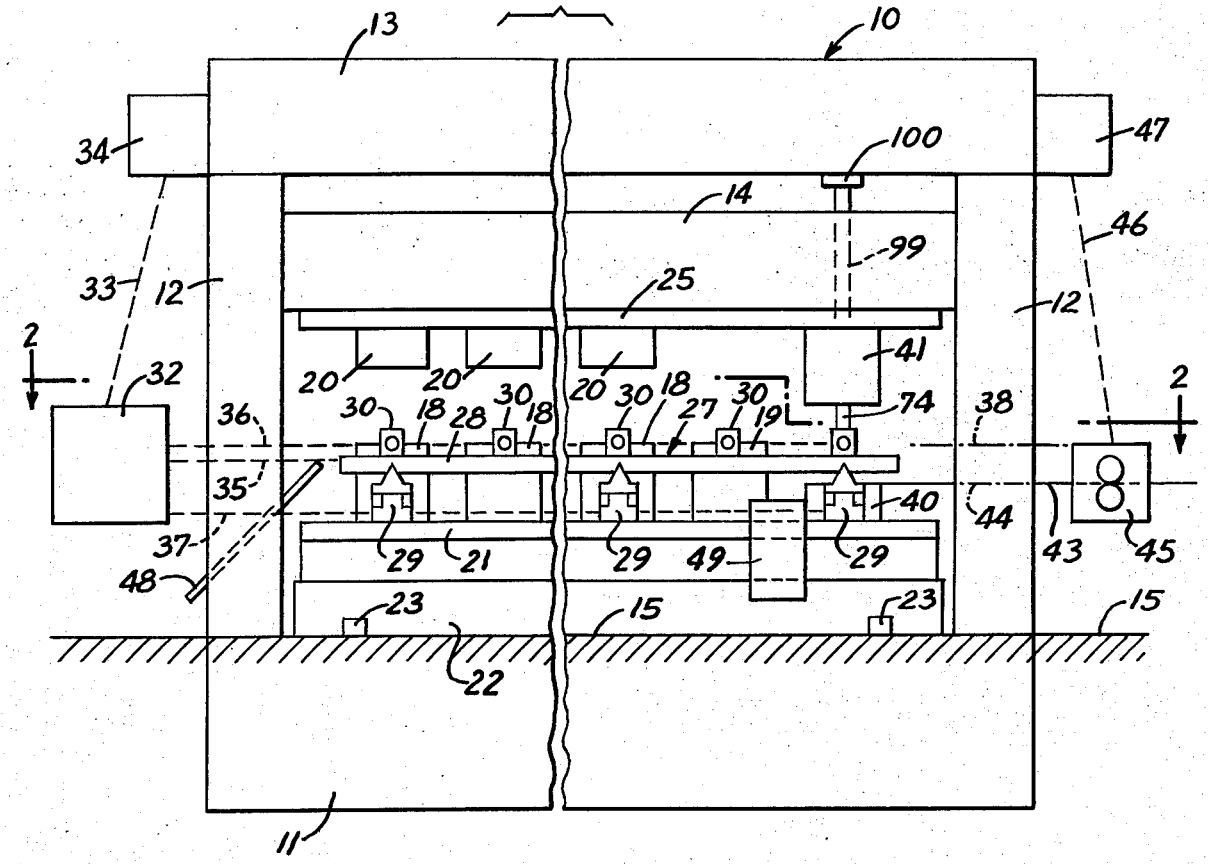
FIG. 1 is a diagrammatic side elevational view of a transfer press with the blanking apparatus located therein.
Figure 2:
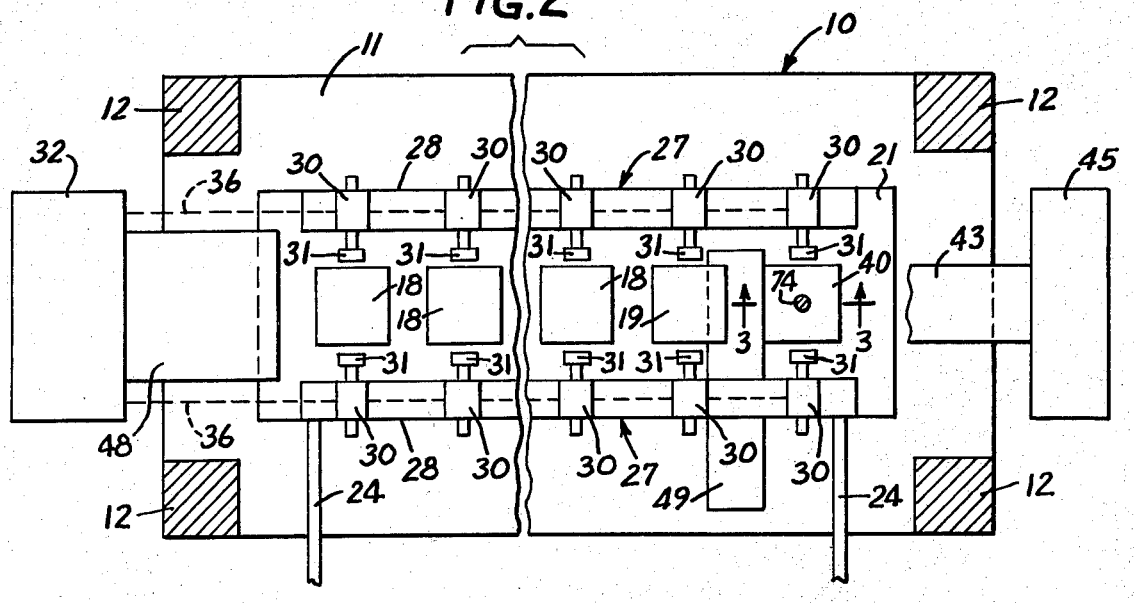
FIG. 2 is a diagrammatic horizontal view of the bottom portion of the press taken substantially along the line 2—2 of FIG. 1.

While the transfer press may have various configurations and constructions including single or multiple die spaces, a single die space press and single die space transfer press is diagrammatically illustrated at 10 in FIGS. 1 and 2. The transfer press 10 includes a frame comprising a bed 11 connected by columns 12 to a crown 13. It also includes a slide 14 moved upwardly and downwardly by power driven apparatus normally arranged within the crown 13. The floor line of the transfer press is indicated at 15.

A plurality of spaced apart stations are arranged longitudinally along the transfer press and they include a plurality of work performing die parts 18 associated with the bed 11 of the press. They also include an idle transfer station 19. A plurality of die parts 20 are associated with the slide 14 of the press, the die parts 20 cooperating with the die parts 18 for performing work functions in the press.

The lower die parts 18 and 19 are preferably carried by a bolster adapter 21 which in turn is carried by a bolster carriage 22. The bolster carriage is provided with suitable rollers 23 operable on the laterally extending tracks 24 so that the bolster carriage and the parts carried thereby may be laterally moved into and out of position in the transfer press. When the bolster carriage 22 is moved into position in the press, it is held in position by suitable clamping means not shown. The upper die parts 20 are also preferably carried by a slide adapter 25 which is removably clamped in place on the slide 14 by clamping means not shown. When a die set including the lower and upper die parts 18 and 20 is to be removed from the transfer press 10, the slide 14 is lowered to engage the upper die parts 20 with the lower die parts 18 and then the slide adapter 25 is unclamped from the slide 14 which is then raised. The bolster carriage 22 is unclamped from the bed 11 and then the entire die set is moved out of the transfer press along the tracks 24. The bolster carriage may be power operated for this purpose. A new die set having different die parts for performing different work functions may then be readily inserted into the transfer press by means of a different bolster carriage carrying the appropriate die parts and when this new die set is properly arranged in the press, the bolster carriage 22 is clamped to the bed 11 and the slide adapter 25 is clamped to the slide 14. In this way, die sets may be rapidly changed in the transfer press 10.

The transfer press 10 also includes a transfer means generally designated at 27 for transferring work pieces or blanks sequentially from station to station longitudinally of the transfer press 10. The transfer means may be of any desired construction, such as those disclosed in U.S. Pat. Nos. 3,430,779, 3,432,042 or 3,512,391. For purposes of illustration herein, the transfer means of U.S. Pat. No. 3,432,042 may be utilized. The transfer means 27 includes longitudinally movable feed bars 28 carried by supports 29 which are suitably secured to the bolster adapter 21. The feed bars 28 are provided with a gripper mechanism 30 for moving inwardly and outwardly and opening and closing gripper fingers 31. The gripper fingers 31 grip the work pieces or blanks in the transfer press and move the pieces sequentially from one station to the next. The transfer means 27 is operated by a mechanism 32 through a drive 33 from a mechanism 34 on the crown of the press in timed relation with the lowering and raising of the slide 14. The mechanism 32 operates the said bars 28 through a coupling 35 for longitudinally reciprocating the said bars, operates the gripper mechanism 30 through a coupling 36 for moving the gripper fingers 31 inwardly and outwardly and for opening and closing the gripper fingers, and operates the supports 29 through a coupling 37 for raising and lowering the feed bars 28, if this be desired. In the particular transfer means here involved the supports 29 are not operated and therefore the coupling 37 is not utilized so that the feed bars 28 reciprocate in a fixed plane and are not lowered or raised. As a result, the work pieces or blanks are moved longitudinally along the press along the transfer feed line 38.

In the preferred embodiment of this invention, the blanking apparatus is arranged within the die space between the columns 12 of the transfer press, the blanking apparatus including a male blanking punch means 40 associated with the bed 11 and a female blanking die means 41 associated with the slide 14. In this connection, the male blanking punch means 40 is carried by the bolster adapter 21 and the female blanking die means 41 is carried by the slide adapter 25. Thus, the blanking apparatus may be moved into and out of the press in the same time-saving operation as the work function die parts 18 and 20 and transfer means 27 are moved into and out of the press as expressed above.

The coil stock 43 from which the blanks are to be formed is fed into the male blanking punch means 40 along a coil stock feed line 44 which is below the transfer feed line 38. A conventional coil stock feeder 45 is utilized for this purpose and it is powered by a drive 46 from a mechanism 47 carried by the crown 13 of the transfer press and intermittently operated in timed relation with the lowering and raising of the press slide 14. The work pieces or blanks which have been subject to the work functions of the transfer press may be discharged from the press such as by chute 48 extending from below the transfer feed line of the press. The scrap of the coil stock resulting from the blanking operation may be discharged laterally from the press by means of a chute 49 extending from below the coil stock feed line 44.

Figure 3:
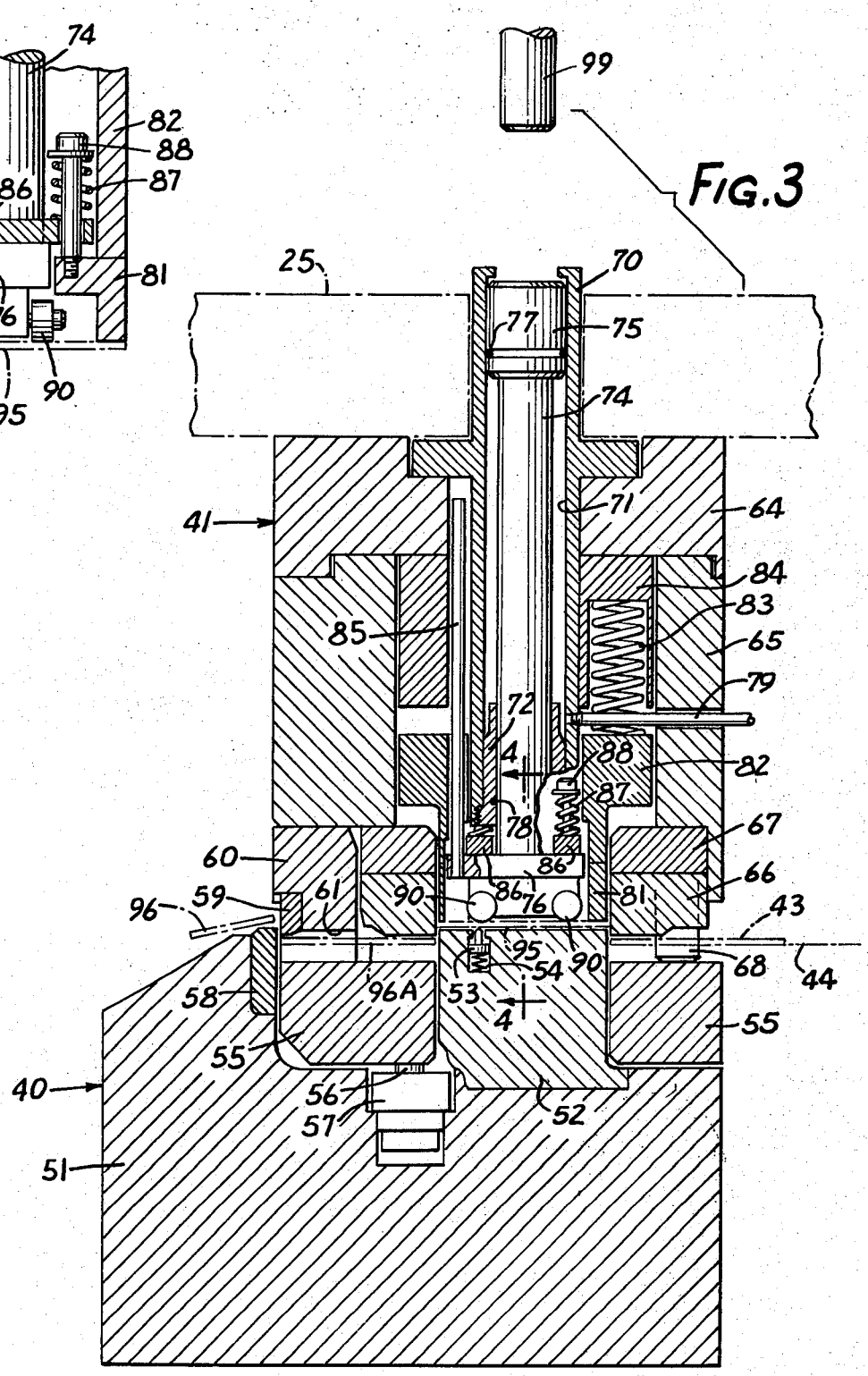
FIG. 3 is a sectional view of the blanking apparatus taken substantially along the line 3—3 of FIG. 2 with the female blanking die lowered following the blanking operation.
Figure 5:
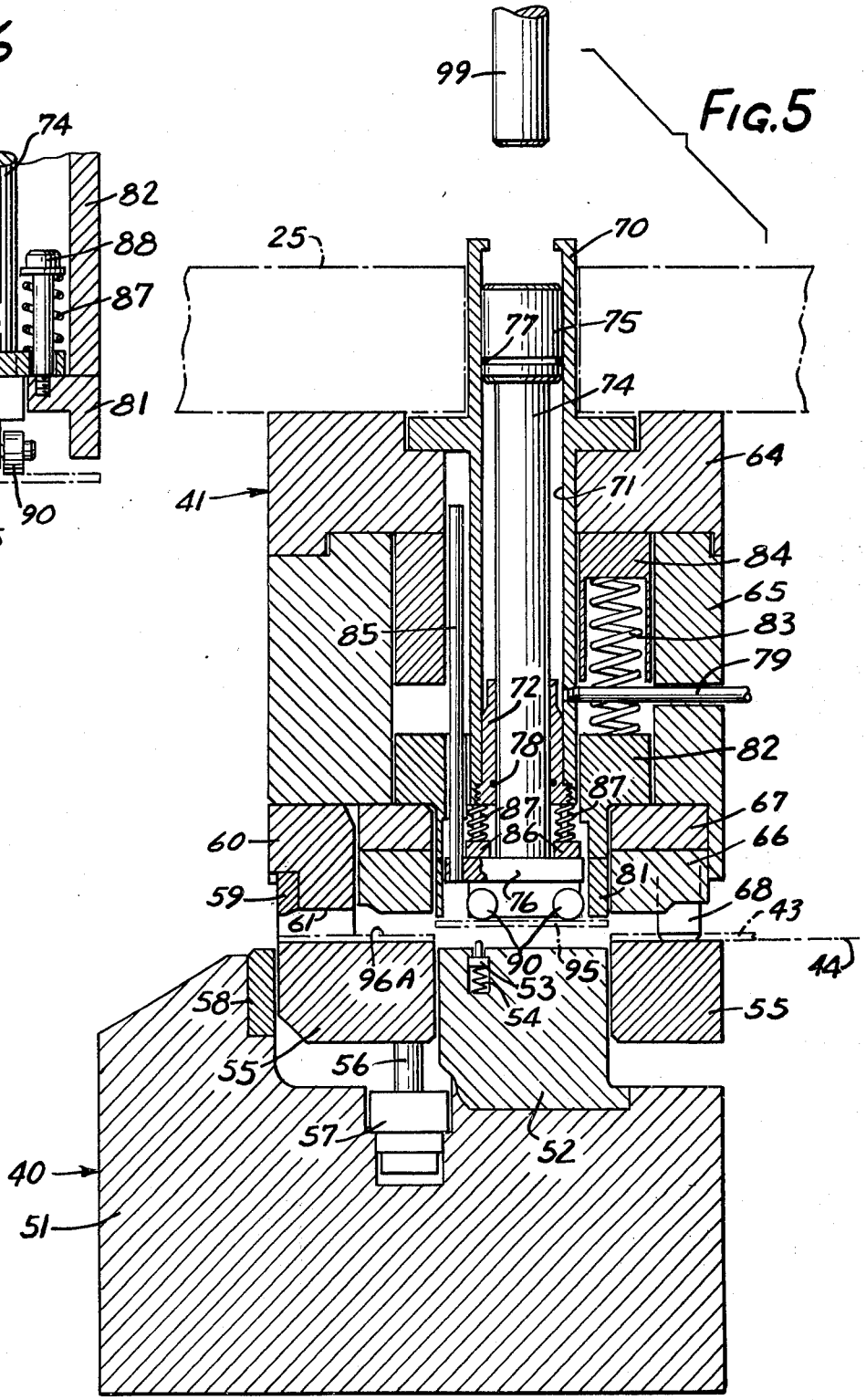
FIG. 5 is a sectional view through the blanking apparatus as illustrated in FIG. 3 but with the female blanking die being raised following the blanking operation.
Figure 7:
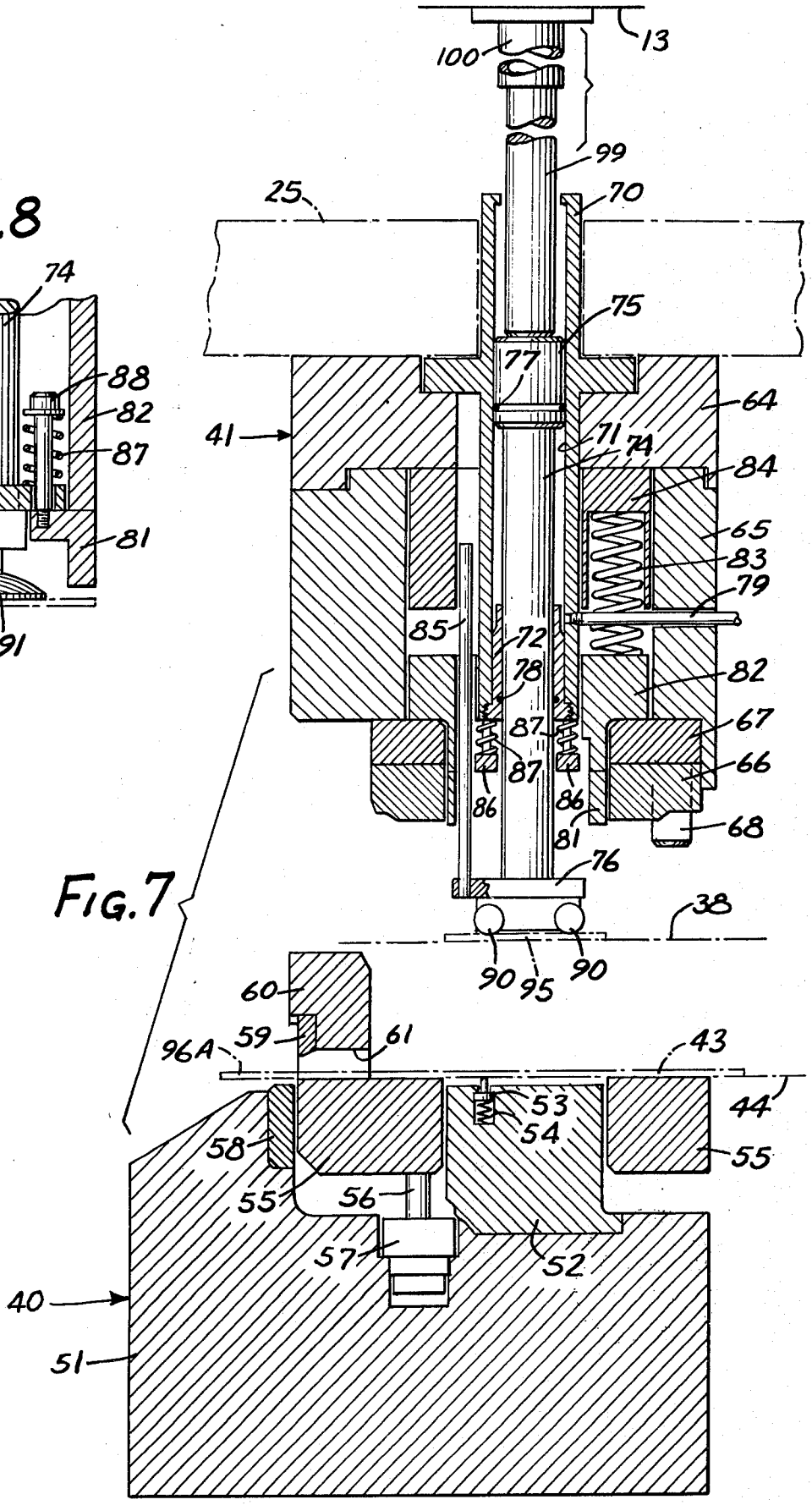
FIG. 7 is a vertical sectional view similar to FIGS. 3 and 5 but showing the female blanking die raised to its upper position.

The male blanking punch means and the female blanking die means are generally designated at 40 and 41, respectively, in FIGS. 3, 5, and 7 and are shown in more detail in these figures. The male blanking punch means 40 includes a tool holder and risers 51 which is suitably secured to the bolster adapter 21. The tool holder 51 carries a male blanking punch 52. The male blanking punch 52 is provided with a plurality of shedder pins 53 which are urged upwardly by springs 54 for shedding a blank from the upper surface of the male blanking punch 52. The tool holder also carries a stripper plate 55 about the male blanking punch 52 for stripping the coil stock 43 from the male blanking punch 52. The stripper plate 55 is resiliently urged upwardly by a plurality of pins 56 operated by oil cylinders 57. Where the blanking operation is such as to provide a skeleton of coil stock, shearing knives 58 and 59 are provided for shearing the skeleton into small pieces of scrap. The shearing knife 58 is carried by the tool holder 51 and the shearing knife 59 is carried by a bridge member 60 which is vertically movably carried by the tool holder 51 and spring biased upwardly to the position illustrated in FIG. 7. The bridge member 60 has an opening 61 through which the skeleton of the coil stock may pass to the shearing knives 58 and 59.

The female die means generally designated at 41 includes a backing plate 64 and a tool holder 65 which are both suitably secured to the slide adapter 25 carried by the slide 14. A female blanking die 66 and a backing plate 67 are suitably secured to the tool holder 65. The tool holder 65 also carries a plurality of outboard timing pins 68 for depressing the stripper plate 55 "in time" with the scrap shearing knife 59.

A pickup head cylinder assembly 70 is carried by the slide adapter 25 and the backing plate 64 within the tool holder 65 and it includes an internal cylinder 71 having a packing member 72 secured to the bottom end thereof. A piston rod 74 is arranged in the cylinder 71 and is provided at its upper end with a piston 75 which is sealed in the cylinder 71 by a seal 77 such as an O-ring. The lower end of the piston rod 74 is sealed in the packing member 72 by sealing means 78 such as an O-ring. A conduit 79 leading from a source of air under pressure, not shown, supplies air under pressure into the cylinder 71 between the piston 75 and the packing member 72 so as to continuously resiliently urge the piston rod 74 upwardly. A pick up head 76 is secured to the bottom end of the piston rod 74.

A die stripper 81 secured to a backing member 82 is arranged within the female blanking die 66 and is slidably mounted in the tool holder 65. A plurality of springs 83 are arranged between the backing member 82 of the stripper 81 and a member 84 engaging the backing member 64 for continuously and resiliently urging the stripper 81 and its backing member 82 downwardly. The downward movement of the stripper 81 and backing member 82 is limited by the backing member 67 for the female blanking die 66 as illustrated in FIGS. 5 and 7. A pin 85 carried by the pick up head 76 extends upwardly through a hole in the backing member 82 and through cavities in the member 84 and backing member 64. The pin 85 operates to prevent angular rotation of the head 76 with respect to the female blanking die 66 and stripper 81.

Figure 4:
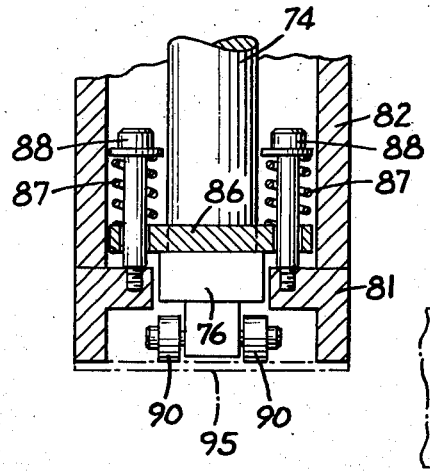
FIG. 4 is a transverse sectional view of a portion of the blanking apparatus illustrated in FIG. 3 and taken substantially along the line 4—4 of FIG. 3.
Figure 6:
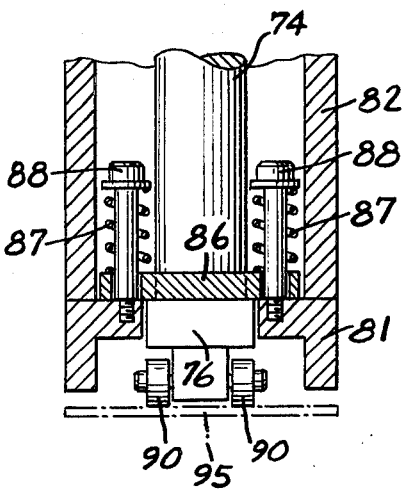
FIG. 6 is a sectional view similar to FIG. 4 but showing the parts in the position illustrated in FIG. 5.

A pair of shedder cross bars 86 are arranged on opposite sides of the piston rod 74 above the pick up head 76 and are resiliently urged against the pick up head 76 by springs 87 carried by studs 88 secured to the stripper 81 as shown more clearly in FIGS. 3 and 4. The bars 86 are normally urged by the springs 87 against the stripper 81 which forms a fixed lower stop for the bars as illustrated in FIG. 6. The springs 87 also operate as resilient stops for resiliently limiting the upward movement of the bars 86 as illustrated in FIG. 4.

Figure 8:
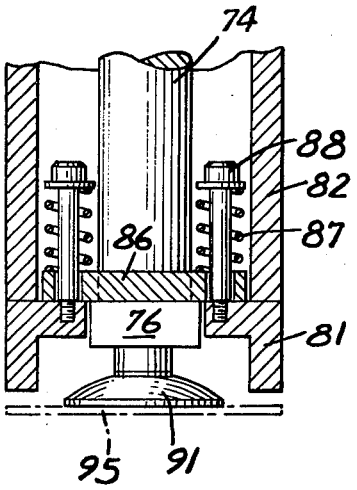
FIG. 8 is a view similar to FIG. 6 but illustrating a different manner of elevating the blank.

The pick up head 76, in accordance with one form of this invention, carries a plurality of magnets 90 as illustrated in FIGS. 3 to 7 for engaging and magnetically coupling the blanks formed by the blanking operation to the pick up head 76. In another form of the invention as illustrated in FIG. 8 a suction cup 91 carried by the pick up head 76 engages and couples by vacuum the blanks formed by the blanking operation as illustrated in FIG. 8. The pick up head 76, piston rod 74 and piston head 75 and the parts associated therewith form an elevating means for elevating the blanks formed by the blanking operation from the male blanking die 52 upwardly to the transfer feed line 38 as illustrated in FIG. 7. In FIGS. 3 to 8 the coil stock to be blanked is designated at 43 and is intermittently fed into the blanking apparatus along the coil stock feed line 44. The blanks formed by the blanking operation are indicated at 95 and the blanks are elevated by the elevating means from the male blanking punch 52 and coil stock feed line 44 upwardly to the transfer feed line 38.

The upward movement of the elevating means is limited by a fixed stop 99 engageable by the piston 75 of the piston rod 74. This fixed stop 99 may be secured by a suitable fitting 100 to the crown 13 of the transfer press above the slide 14. This stop 99 may be made adjustable so that the blanks 95 are elevated precisely to the transfer feed line 38 as illustrated in FIG. 7. In FIGS. 3, 5 and 7, the scrap of the coil stock following the blanking operation is designated at 96 and where the scrap is in the form of a skeleton before being sheared by the shearing knives 58 and 59, the scrap is designated at 96A.

In the operation of the blanking apparatus the parts are shown in the positions illustrated in FIG. 3 at the bottom of the stroke of the slide 14 following the blanking of a blank 95 from the coil stock 43 and following the shearing of the scrap skeleton 96A by the shearing knives 58 and 59. In this position the female blanking die 66 is under and around the male blanking punch 52, the stripper 81 is engaging the blank 95 by reason of the springs 83 and the pick up head 76 with its magnets 90 are engaging the blank 95 and the shedder cross bars 86 are lifted from the stripper 81 against the action of the springs 87. The springs 87 operate as a resilient stop for this separation of the shedder bars 86 from the stripper 81. The shearing knives 58 and 59 have sheared the skeleton 96A into scrap parts 96. The outboard timing pins 68 have depressed the lower stripper plate 55 in timed relation with the shearing by the shearing knives 58 and 59. Also, the shedder pins 53 in the male blanking punch 52 have been depressed.

When the slide 14 and the parts carried thereby move upwardly from the lowered position of the slide to the position of the parts illustrated in FIGS. 5 and 6, the female blanking die 66 is first moved upwardly from around the male blanking punch 52 while the stipper 81 is holding the blank 95 against the upper surface of the male blanking punch 52. At this time also the magnets 90 are engaging the blank 95. As the female die continues to move upwardly the stripper 81 strips the blank 95 downwardly from the female blanking die 66 while the blank 95 is being held against the male blanking punch 52. Following the stripping of the blank 95 from the female blanking die 66, the stripper 81 is caused to move upwardly by the backing member 67 engaging the backing member 82, the blank 95 being initially caused to follow the stripper 81 by reason of the magnets 90. Upon upward movement of the stripper 81 the springs 87 acting on the shedder bars 86 cause the pick up head to shed the blank 95 from the lower edge of the stripper 81 as illustrated in FIG. 6. As the blank 95 is thus being raised, the shedder pins 53 operate to shed the blank 95 from the upper face of the male blanking punch 52 to assure that the magnets 90 have a solid grip on the blank 95 as it is being raised from the male blanking punch 52. Also during this upward movement, the timing pins 68 allow upward movement of the stripper 55 about the male blanking punch 52 to strip the coil stock 43 from the male blanking punch, this being afforded by the pins 56 and oil cylinders 57.

Also, during this initial upward movement of the slide 14 the bridge member 60 is allowed to follow the tool holder 65 so as to separate the shearing knives 58 and 59.

In the continued upward movement of the slide 14 from the position illustrated in FIG. 5 to the position illustrated in FIG. 7, the various parts remain in the same relative positions as illustrated in FIG. 5 until the piston 75 of the piston rod 74 engages the fixed stop 99, as illustrated in FIG. 7. When this occurs, upward movement of the elevating means is stopped with the blank 95 arranged along the transfer feed line 38 of the transfer press. The slide continues in its upward movement beyond this point so that the various parts of the upper female die means 41 are elevated above the transfer feed line. When the parts are moved to the position illustrated in FIG. 7 the transfer means of the transfer press removes the blank 95 from the magnets 90 and transfers that blank to the idle transfer station 19 in the transfer press where the blank is deposited. At this same time, the coil stock is intermittently fed over the male blanking punch 52 in preparation for another blanking cycle. As the slide 14 is then lowered, the pick up head 76 is maintained in its elevated position until it is engaged by the shedder bars 86 whereupon the elevating means is lowered with the female blanking die 66 in the relative positions illustrated in FIG. 5. Upon further lowering, the timing pins engage the stripper 55 to lower the same, the magnets 90 engage the coil stock 43 above the male blanking punch 52, the stripper 81 engages the coil stock agove the male blanking punch 52, and the shedder pins 53 are retracted to hold the coil stock 43 firmly against the face of the blanking punch 52. Further downward movement of the slide then causes the female die to lower over the male blanking punch 52 and thus perform the next blanking operation. The tool holder 65 also engages the bridge 60 for operating the shearing knives 58 and 59 to cut the coil stock skeleton 96A into small scrap pieces 96. From this point, the blanking cycle is completed in the manner described above.

Figure 9:
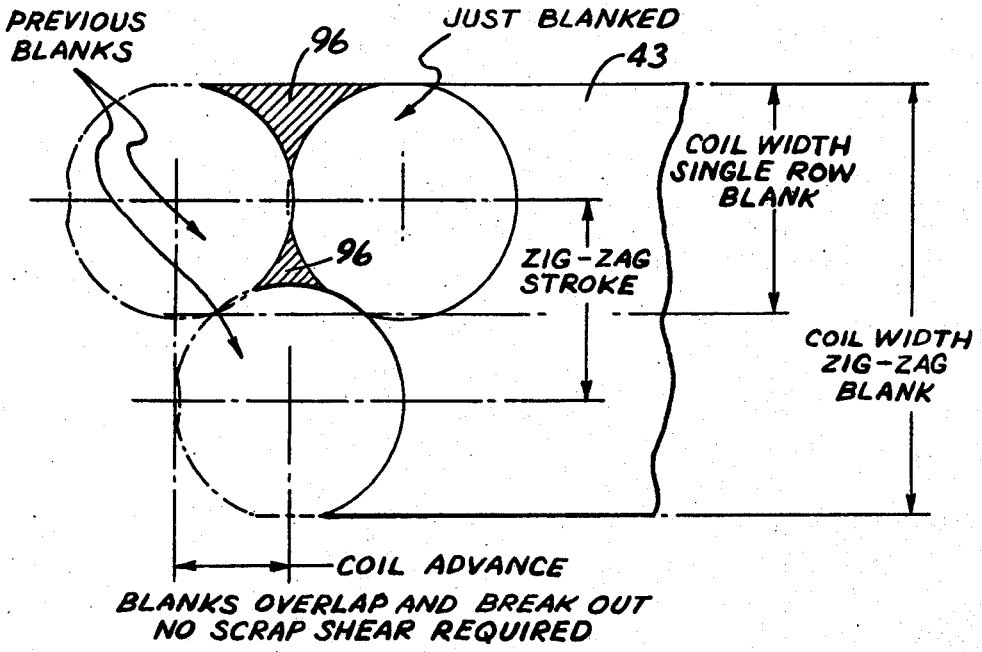
FIG. 9 is a diagrammatic illustration of a coil stock which has been blanked by the blanking apparatus and wherein the scrap following the blanking operation is in small separate pieces.
Figure 10:
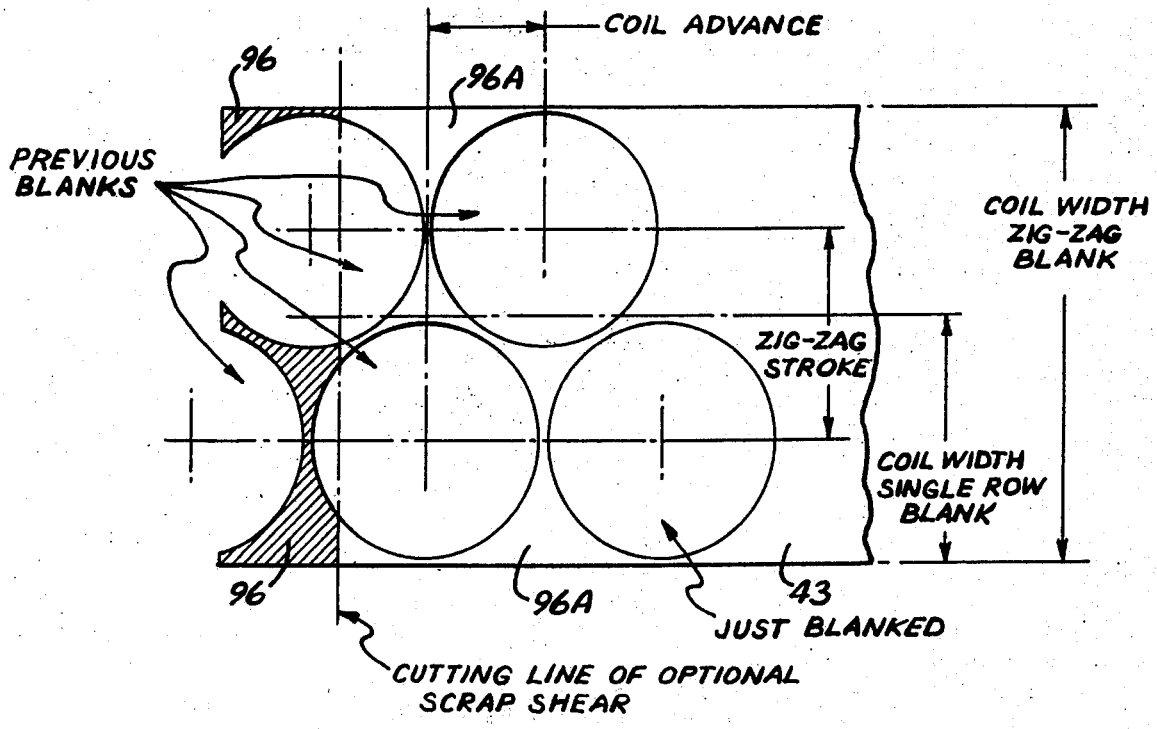
FIG. 10 is a diagrammatic illustration similar to FIG. 9 but illustrating the blanking operation resulting in a coil stock skeleton which is then sheared into small separate scrap pieces.

As expressed above, the coil stock feeding means 45 may be of conventional construction and it may intermittently feed the coil stock 43 to the blanking apparatus along the coil stock feed line 44 in a straight longitudinal manner or it may feed the coil stock in a zigzag manner. FIGS. 9 and 10 illustrate the blanking operations for both the longitudinal coil stock feed and the zigzag feed. In FIG. 9 the coil stock 43 is of such a width that the coil stock is blanked through leaving small scrap pieces 96 and no skeleton. In FIG. 10 the coil stock 43 is of such width that it is not blanked through leaving a coil stock skeleton 96A which is then sheared into small pieces by the shearing knives 58 and 59. The shearing knives are utilized in connection with the coil stock of FIG. 10 but are unnecessary and not utilized in connection with the coil stock of FIG. 9. The various designations in FIGS. 9 and 10 are self-explanatory and accordingly further description with respect to these figures is unnecessary.

During each operating cycle of the transfer press 10, the coil stock 43 is fed to the blank apparatus 40, 41 along the coil stock feed line 44 which is below the transfer feed line 38 of the transfer press, the coil stock scrap 96 is discharged below the coil stock feed line 44 as by a chute 49, the blank 95 is elevated in the blanking apparatus station 40, 41 to the transfer feed line 44, and the transfer means 21 transfers along the transfer feed line 44 the blank 95 from the blanking apparatus station 40, 41 to the idle station 19, transfers along the transfer feed line 44 blanks from the idle station 19 successively through the work performing stations 18, 20 where work functions are performed thereon, and discharges a completed work piece or blank below the transfer feed line 44 as by a chute 48. The construction and operation of the blanking apparatus 40, 41 is such that it may be readily incorporated in the die set apparatus within the transfer press 10 and it is preferably so utilized for reasons expressed above, although it may be advantageously arranged otherwise with respect to the transfer press as set forth above. In both events the blanking apparatus 40, 41 is such as to prevent the coil stock scrap 96 from interfering with the operation of the transfer means 21 and the blanks 95 being transferred thereby.

While for purposes of illustration a preferred form of this invention has been disclosed, other forms thereof may become apparent to those skilled in the art upon reference to this disclosure and, therefore, this invention is to be limited only by the scope of the appended claims.

We claim:

1. A method for blanking from coil stock blanks to be supplied to and formed in a transfer press having a transfer feed line through the press along which the blanks are fed, comprising the steps of intermittently feeding the coil stock over an upwardly facing lower male blanking punch along a coil stock feed line which is located below the transfer feed line of the press, lowering a downwardly facing upper female blanking die from above the transfer feed line of the press over the male blanking punch for blanking blanks from the coil stock, raising the female blanking die above the transfer feed line of the press, elevating the blanks from the male blanking punch to the transfer feed line of the press for transfer thereof along the transfer feed line, and discharging the scrap of the coil stock along the coil stock feed line below the transfer feed line of the press.

2. The method as defined in claim 1, including the step of stripping the blanks from the female blanking die as the female blanking die is being raised.

3. The method as defined in claim 2 wherein said stripping of the blanks from the female blanking die occurs near the beginning of the raising of the female blanking die.

4. The method as defined in claim 1, including the step of stripping the coil stock from the male blanking punch as the female blanking die is being raised.

5. The method as defined in claim 4, wherein said stripping of the coil stock from the male blanking punch occurs near the beginning of the raising of the female blanking die.

6. The method as defined in claim 1, including the steps of stripping the blanks from the female blanking die and stripping the coil feed stock from the male blanking punch as the female blanking die is being raised.

7. The method as defined in claim 6 wherein said stripping of the blanks from the female blanking die and the coil feed stock from the male blanking punch occurs near the beginning of the raising of the female blanking die.

8. The method as defined in claim 1, including the step of shearing the scrap as it is being discharged along the coil stock feed line.

9. The method as defined in claim 1 wherein the elevating of the blanks is accomplished magnetically.

10. The method as defined in claim 1 wherein the elevating of the blanks is accomplished by vacuum.

11. An apparatus for blanking from coil stock blanks to be supplied to and formed in a transfer press having a transfer feed line through the press along which the blanks are fed, comprising in combination, means for intermittently feeding the coil stock along a coil stock feed line which is located below the transfer feed line of the press, an upwardly facing lower male blanking punch over which the coil stock is so fed, a downwardly facing upper female blanking die in vertical alignment with the male blanking punch, means for lowering the female blanking die from above the transfer feed line of the press over the male blanking punch for blanking blanks from the coil stock and for raising the female blanking die above the transfer feed line of the press, elevating means associated with the female blanking die for elevating the blanks to the transfer feed line of the press as the female blanking die is raised for transfer of the blanks along the transfer feed line of the press, and discharge means for discharging the scrap of the coil stock along the coil stock feed line below the transfer feed line of the press.

12. The apparatus as defined in claim 11 including stripping means associated with the female blanking die for stripping the blanks from the female blanking die as the female blanking die is being raised.

13. The apparatus as defined in claim 12 including means for causing the stripping means to strip the blanks from the female blanking die near the beginning of the raising of the female blanking die.

14. The apparatus as defined in claim 11 including stripping means associated with the male blanking punch for stripping the coil stock from the male blanking punch as the female blanking die is being raised.

15. The apparatus as defined in claim 14 including means for causing the stripping means to strip the coil stock from the male stamping punch near the beginning of the raising of the female blanking die.

16. The apparatus as defined in claim 11 including stripping means associated with the female blanking die for stripping the blanks from the female blanking die and stripping means associated with the male blanking punch for stripping the coil stock from the male blanking punch as the female blanking die is being raised.

17. The apparatus as defined in claim 16 including means for causing said stripping means to strip the blanks from the female blanking die and to strip the coil stock from the male blanking punch near the beginning of the raising of the female blanking die.

18. The apparatus as defined in claim 11 including shear knives associated with the male blanking punch and the female blanking die for shearing the scrap as it is being discharged along the coil stock feed line.

19. The apparatus as defined in claim 11 wherein said elevating means includes magnetic means for engaging and magnetically attracting the blanks to elevate the same from the male blanking punch to the transfer feed line.

20. The apparatus as defined in claim 11 wherein said elevating means includes vacuum cup means for engaging and vacuum coupling the blanks to elevate the same from the male blanking punch to the transfer feed line.

21. The apparatus as defined in claim 11 including stripping means within the female blanking die and longitudinally movable with respect thereto for stripping the blanks from the female blanking die as the female blanking die is being raised, and said elevating means being arranged within the stripping means and the female blanking die and being longitudinally movable with respect to the stripping means and the female blanking die as the female blanking die is being raised.

22. The apparatus as defined in claim 21 including a stationary stop for engaging and stopping the elevating means when the blanks carried thereby are elevated to the transfer feed line of the press as the female blanking die and stripping means are being raised.

23. The apparatus as defined in claim 11 including stripping means within the female blanking die and longitudinally movable with respect thereto, biasing means for resiliently biasing the stripping means downwardly against a stop in the female blanking die to cause the stripping means to first resiliently engage the coil stock and retract as the female blanking die engages the coil stock to blank the same as the female blanking die is lowered and to cause the stripping means resiliently to extend as the female blanking die is raised to resiliently strip the blank from the female die as the female blanking die is raised, said elevating means being arranged within the stripping means and the female blanking die and being longitudinally movable with respect thereto, biasing means for resiliently biasing the elevating means upwardly with respect to the stripping means and the female blanking die against a resilient stop in the stripping means, said resilient stop causing the elevating means to first resiliently engage the coil stock and retract as the stripping means engages the coil stock when the stripping means is lowered and causing the elevating means to resiliently extend as the stripping means is raised to shed the blank from the stripping means, and a stationary stop for engaging and stopping the elevating means when the blanks carried thereby are elevated to the transfer feed line of the press as the female blanking die and stripping means are being raised.

24. The apparatus as defined in claim 11 including shedding means on the male blanking punch for shedding the blanks therefrom.

25. A transfer press including a frame, a bed and a vertically movable slide, a plurality of longitudinally spaced forming stations, each including die parts associated with the bed and the slide for performing work functions as the slide is lowered and raised on blanks sequentially transferred thereto, transfer means for sequentially transferring blanks along a transfer feed line of the press to the longitudinally spaced forming stations, and a blanking apparatus for blanking from coil stock blanks to be supplied to the transfer means at the transfer feed line of the press and to have work functions sequentially performed thereon by the longitudinally spaced forming stations of the press, the improvement wherein, said blanking apparatus comprises, means for intermittently feeding the coil stock along a coil stock feed line which is located below the transfer feed line of the press, an upwardly facing lower male blanking punch over which the coil stock is fed, a downwardly facing upper female blanking die in vertical alignment with the male blanking punch, means for lowering the female blanking die from above the transfer feed line of the press over the male blanking punch for blanking blanks from the coil stock and for raising the female blanking die above the transfer feed line of the press, elevating means associated with the female blanking die for elevating the blanks to the transfer feed line of the press as the female blanking die is raised for transfer of the blanks along the transfer feed line of the press by the transfer means, and discharge means for discharging the scrap of the coil stock along the coil stock feed line below the transfer feed line of the press.

26. The transfer press as defined in claim 25 wherein the male blanking punch of the blanking apparatus is associated with the bed within the transfer press and the female blanking die and elevating means of the blanking apparatus are associated with the slide within the press to be also lowered and raised thereby.

27. The transfer press as defined in claim 26 wherein the coil stock is fed over the male blanking punch within the transfer press longitudinally from one end of the press, and wherein the scrap of the coil stock resulting from the blanking operation is discharged laterally from the transfer press.

28. The transfer press as defined in claim 25 including a slide adapter removably secured to the slide of the press for carrying the die parts associated with the slide, a bolster carriage and adapter removably secured to the bed of the press for carrying the die parts associated with the bed and the transfer means, said male blanking punch of the blanking apparatus being carried by the bolster carriage and adapter, and said female blanking die and elevating means of the blanking apparatus being carried by the slide adapter to be also lowered and raised by the slide.

29. The transfer press as defined in claim 28 wherein the coil stock is fed over the male blanking punch within the transfer press longitudinally from one end of the press, and wherein the scrap of the coil stock resulting from the blanking operation is discharged laterally from the transfer press.

30. The transfer press as defined in claim 27 including shear knives associated with the male blanking punch and the female blanking die for shearing the scrap of the coil stock as it is being discharged along the coil stock feed line before it is discharged laterally from the transfer press.

31. The transfer press as defined in claim 29 including shear knives associated with the male blanking punch and the female blanking die for shearing the scrap of the coil stock as it is being discharged along the coil stock feed line before it is discharged laterally from the transfer press.

* * * * *